US005611280A

United States Patent [19]

Orlandini

[11] Patent Number: 5,611,280

[45] Date of Patent: Mar. 18, 1997

[54] MOUNTING ARRANGEMENT OF THE BARS SUPPORTING THE GRIPPERS IN MAP-MAKING OR SECURITY-PAPER PRINTING MACHINES

[75] Inventor: Dante Orlandini, Novegro Segrate, Italy

[73] Assignee: Ormag S.P.A., Milan, Italy

[21] Appl. No.: 370,974

[22] Filed: Jan. 10, 1995

[30] Foreign Application Priority Data

Jan. 26, 1994 [IT] Italy ..... MI94A0119

[51] Int. Cl.[6] ..... B41F 1/30

[52] U.S. Cl. ..... 101/409; 271/204

[58] Field of Search ..... 101/408, 409, 101/410, 411, 412; 271/204, 82, 85

[56] References Cited

U.S. PATENT DOCUMENTS

| | | | |
|---|---|---|---|
| 3,809,390 | 5/1974 | Lenoir | 271/204 |
| 4,524,964 | 6/1985 | Jamieson, Jr. | 271/204 |
| 4,530,495 | 7/1985 | Zimmerman et al. | 101/408 X |
| 5,303,650 | 4/1994 | Wieland | 271/82 X |
| 5,396,842 | 3/1995 | Quinci et al. | 101/409 |

FOREIGN PATENT DOCUMENTS

| | | |
|---|---|---|
| 0189828 | 8/1986 | European Pat. Off. . |
| 0448943 | 10/1991 | European Pat. Off. . |
| 878353 | 9/1961 | United Kingdom . |
| 1003838 | 9/1965 | United Kingdom . |
| 1149881 | 4/1969 | United Kingdom . |

*Primary Examiner*—Christopher A. Bennett
*Attorney, Agent, or Firm*—Young & Thompson

[57] ABSTRACT

Mounting arrangement of the bars supporting the grippers in a map-making or security-paper printing machine, wherein each bar consists of a pair of parallel tubular rods and is supported at its opposite ends on two transport chains slidable along two parallel fixed guides, each bar end being mounted on a pair of pins fixed to the chains and projecting therefrom towards the bar. Between the bar ends and the pairs of support pins there is interposed an intermediate support, formed by two elements adapted to slide telescopically one in respect of the other in a direction parallel to the sliding plane of the chains and lengthwise of the chains, one of these elements, in the form of a plate, comprising two transverse bores to house the pins of the chain, while the other element, in the form of a slide, is fixed to an end of each bar and is slidably mounted on the plate.

9 Claims, 2 Drawing Sheets

MOUNTING ARRANGEMENT OF THE BARS SUPPORTING THE GRIPPERS IN MAP-MAKING OR SECURITY-PAPER PRINTING MACHINES

BACKGROUND OF THE INVENTION

The present invention concerns a mounting arrangement of the bars supporting the grippers in a map-making machine, and more specifically a machine for printing security-paper, particularly a color printing machine.

It is known that, in map-making machines of this type, the paper to be printed, or already printed, is in single sheets being conveyed one by one, in succession, between printing rolls or other processing means. Due to the nature of the product being treated, it is known that a very high precision—for example of the order of a few millimeter tenths—is required in conveying the single sheets.

The paper sheets are drawn singly from a feed pile, are conveyed along the machine by means of rolls or other devices and, at the end of an intermediate travelling path, they are clamped by grippers mounted on one or more bars and are conveyed to the outlet of the machine.

Each of these bars actually consists of a pair of parallel rods, one of which is simply adapted to support a plurality of parallel grippers, while the other one is also adapted to control the opening and closing of the grippers.

Said rods are normally supported, at their opposite ends, on a pair of transport chains moving along a closed ring path.

The assembly is usually quite simple since said rods, which have a tubular configuration, are engaged with their ends in the transport chains merely by way of pins.

This transport system—which has proved up-to-date fully satisfactory as to its precision in conveying the paper sheets in map-making and, specifically, security-paper printing machines—suffers however from quite a serious drawback: when, accidentally, one or more sheets of paper, or a foreign matter, cause jamming along the travelling path, which can also damage the aforecited transport grippers, the necessary maintenance operation to eliminate the jamming turns out to be extremely difficult.

In fact—bearing in mind that each rod is mounted with precision between two transport chains sliding with precision along two fixed parallel guides—it can be easily understood how, in order to disassemble the rods, it is necessary to remove at least one of the two chains from its slide guide, and often both chains.

However, taking into account that—as stated above—said guides essentially form a closed ring path, it is evident that they also need to be removed in order to allow removal of the chains. This operation could be merely toilsome—for the guides positioned in some of the more easily accessible areas of the machine—but it can even become impossible unless other parts of the machine are first removed.

SUMMARY OF THE INVENTION

The object of the present invention is to thus propose a mounting arrangement of the bars supporting the grippers which, without evidently forgoing a precision guide, is adapted to facilitate removal of said bars in case of jamming. This object is achieved due to the fact that said mounting arrangement provides for an intermediate support between the ends of the bars and the pairs of support pins fixed to the chains, said intermediate support being formed of two elements adapted to slide telescopically one in respect of the other in a direction parallel to the sliding plane of the chains.

According to a preferred embodiment, said intermediate support comprises a plate element, mounted on each pair of pins of the transport chain and, respectively, a slide element fixed to one end of the bar and slidable in respect of said plate element.

BRIEF DESCRIPTION OF THE DRAWINGS

Further characteristics and advantages of the mounting arrangement according to the present invention will be more evident from the following detailed description of a preferred embodiment thereof, given by way of example and illustrated on the accompanying drawings, in which.

DESCRIPTION OF THE PREFERRED EMBODIMENT

Figure 1:
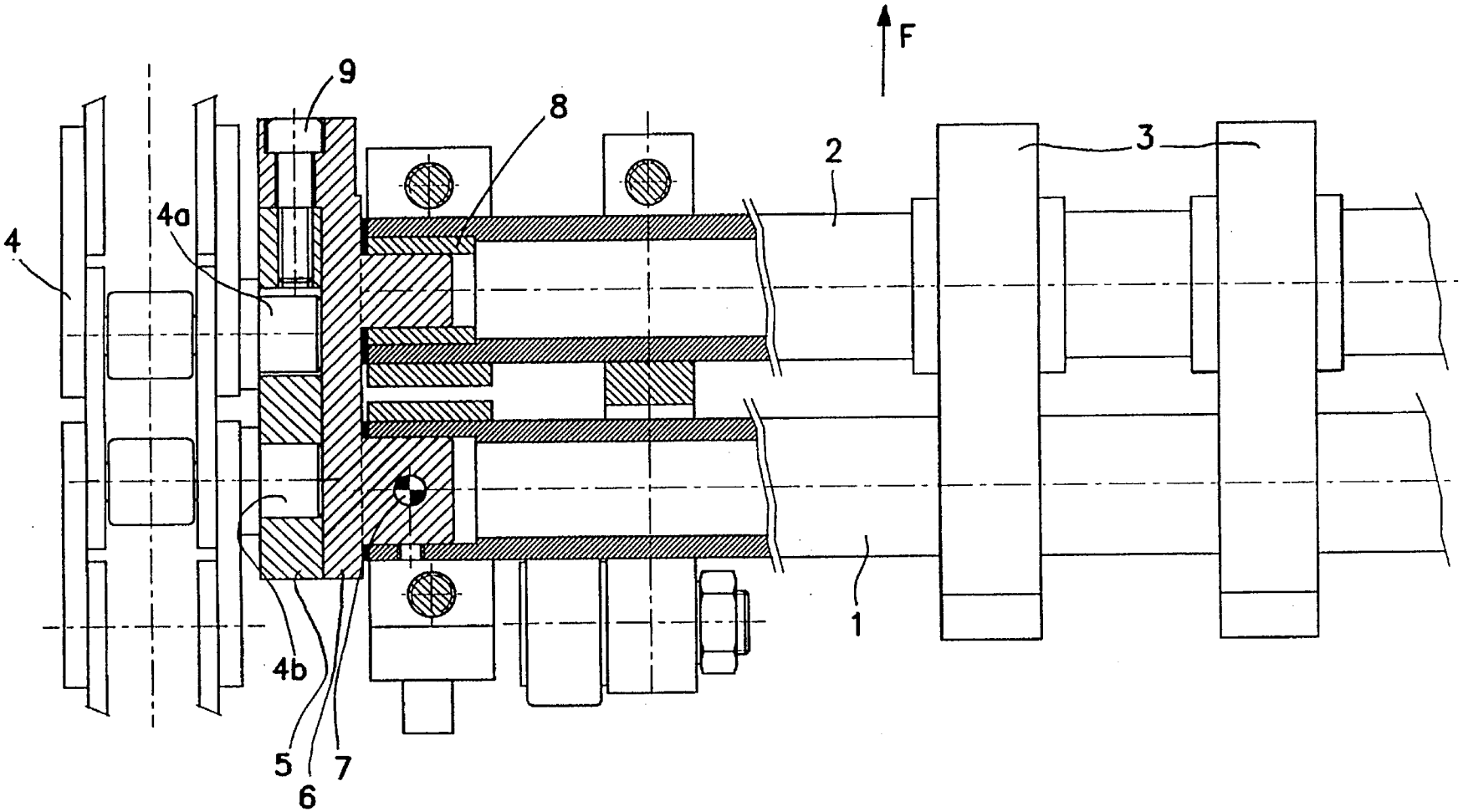
FIG. 1 is a diagrammatic plan view, partly sectioned, of one of the ends of a bar supporting the grippers, comprising an intermediate support according to the invention and mounted on a respective transport chain.

In a map-making machine, the bar supporting the grippers normally comprises a pair of tubular rods 1 and 2, the rod 1 being fixed and the rod 2 being rotatable so as to control the opening and closing of the grippers 3. The bar 1, 2 is moved in a direction F by a pair of parallel chains, of which only the chain 4 is diagrammatically shown on the left of the drawing. Two pins 4*a* and 4*b*, fixed to said chain, project towards the centre of the machine, i.e. of the space between the two parallel chains, the bar 1, 2 being mounted on said pins.

According to the present invention, the mounting of the bar 1, 2 on the chain 4 is carried out by fixing the rods 1 and 2 not directly onto the pins 4*a* and 4*b*—as in prior art—but by way of an intermediate support 5, 6. More precisely, said support consists of a fixed part 5, essentially in the form of a plate element, and of a movable part 6 in the form of a slide element.

Figure 4:
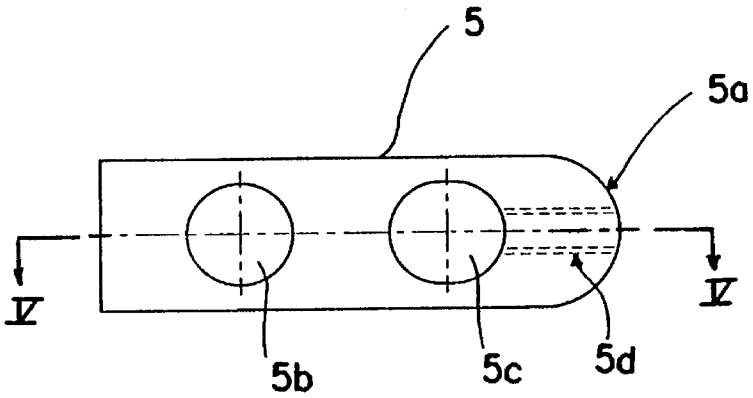
FIG. 4 is an elevation view of the fixed part of the intermediate support according to the invention.
Figure 5:
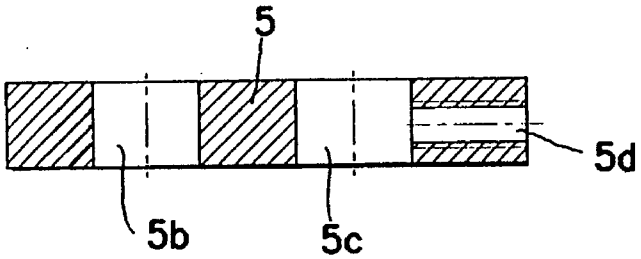
FIG. 5 is a section view along the line V—V of FIG. 4.

As clearly shown in FIGS. 4 and 5, the plate 5 is an essentially flat, elongated, parallelepiped body, with a semicircular head 5*a*. Two bores 5*b* and 5*c* are formed across the plate 5, through its minor thickness. The bore 5*b* is perfectly cylindrical, while the bore 5*c* has a slightly slotted configuration extending in the axial longitudinal direction of the plate 5. A threaded hole 5*d* is moreover formed along the longitudinal axis of the plate 5, between the head 5*a* and the slotted bore 5*c*.

Figure 2:
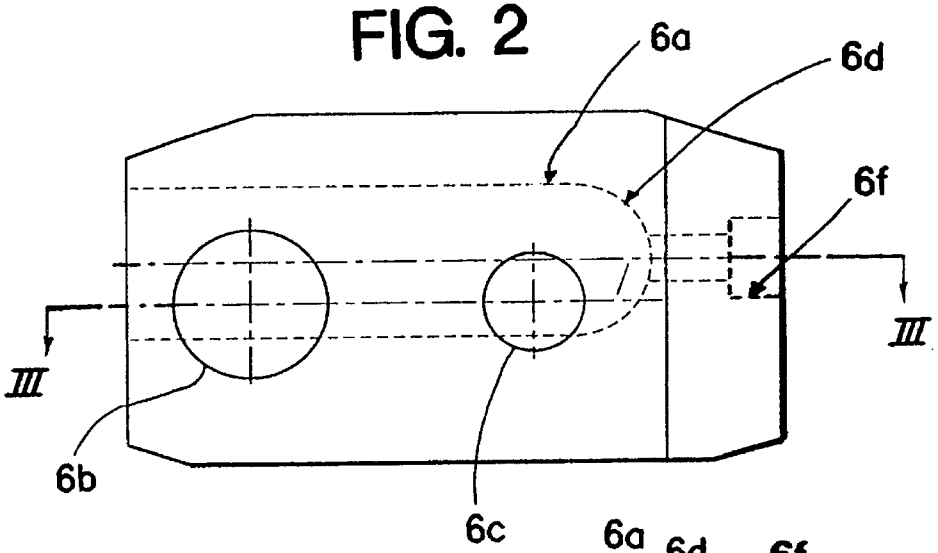
FIG. 2 is an elevation view of the movable part of the intermediate support according to the invention.
Figure 3:
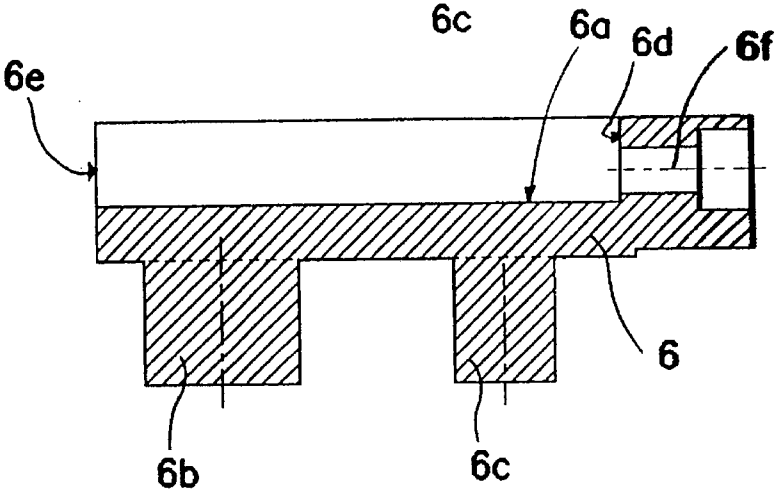
FIG. 3 is a section view along the line III—III of FIG. 2.

The slide 6 is clearly shown in FIGS. 2 and 3. It is in the form of an essentially flat body comprising, on one of its surfaces, a long notch 6*a* adapted to house in a substantially precise manner the plate 5, while two pins 6*b* and 6*c* project from its opposite surface. An end 6*d* of the housing notch 6*a* has an arcuate shape similar to that of the head 5*a* of the plate 5, while its opposite end freely opens on the side 6*e* of the slide body 6. An axial bore 6*f* is moreover formed between the notch end 6*d* and the side of the body 6 opposite to 6*e*. The pin 6*c* has a smaller diameter than the pin 6*b* for the function better described hereinafter.

For assembly the one proceeds, on one hand, to mount the plate 5 on the pins 4*a* and 4*b* of the chain 4 and, on the other hand, to fix the slide 6 on the bars 1, 2.

More precisely, the plate 5 is simply mounted with its bores 5*b* and 5*c* on the pins 4*b* and 4*a*: the bore 5*b* engages with precision on the pin 4*b*, while the bore 5*c* engages on the pin 4*a* with a certain slack in the sense of the longitudinal axis of the plate 5. Said slack is meant to allow very slight axial displacements of the chain 4—for instance determined by wear of the joints—without giving rise to tensile stresses on the plate 5.

To mount the slide 6 on the bar supporting the grippers one inserts the tubular rod 1 directly on the pin 6*b* of wider diameter and fixes it with a locking pin 7; one then inserts the tubular rod 2 on the pin 6*c* of smaller diameter, with the interposition of a bearing 8, for instance a friction bush.

The locking between the rod 1 and the pin 6*b*—guaranteed by the pin 7, both in the axial and in the torsional sense—determines the general stiffness of the whole bar, but allows the rotation of the rod 2 within the limits foreseen for the opening and closing of the grippers.

For final assembly on the machine—after the chains 4 have been positioned in the respective guides and the plates 5 have been mounted on the pins 4*a* and 4*b*—the bars 1, 2 are introduced into the space between the two chains, and the notches 6*a* of the two slides 6 are fitted telescopically on two opposite plates 5 by moving said slides in a direction parallel to the sliding plane, normally vertical, of the chains 4.

The fixing of the slides 6 on the plates 5 is then ensured by means of a screw 9—for instance a socket head screw—driven through the bore 6*f* of the slide 6 and screwed into the threaded hole 5*d* of the plate 5.

It is evident from the above that, in case of jams, the bar supporting the grippers can be easily removed by unscrewing the screw 9 and drawing the slides 6 out of the plates 5 in the direction F, that is, by operating exactly in the sense opposite to that described above for the operation of assembly, and thus without in the least interfering with the chains and the respective slide guides.

It is to be understood that the invention is not limited to the particular embodiment described heretofore, which is merely a non-limiting example, but that a number of variants can be introduced, all within reach of a technician skilled in the art, without thereby departing from the protection field of the invention itself.

I claim:

1. Mounting arrangement in a map-making or security-paper printing machine comprising a pair of parallel tubular rods, two transport chains, means slidably supporting said transport chains for movement lengthwise of said chains with one chain at each end of said rods, two pins fixed to each chain and projecting in the direction of the other chain, an intermediate support carried by said two pins of each chain, each intermediate support comprising two elements removably secured together and disengageable from each other by relative movement lengthwise of said chains, one said element of each intermediate support receiving said pins on said chains, the other element of each intermediate support being connected to adjacent ends of both said rods.

2. Mounting arrangement as claimed in claim 1, wherein one of said two elements comprises a plate mounted on a pair of said pins, and the other of said elements comprises a slide element secured to adjacent ends of said rods and slidable on said plate element parallel to said chains.

3. Mounting arrangement as claimed in claim 2, wherein said slide element has an open-ended elongated notch in which said plate element is slidably received.

4. Mounting arrangement as claimed in claim 3, wherein said plate element is elongated lengthwise of the chain and said open end of said notch is directed away from a direction in which said chains move.

5. Mounting arrangement as claimed in claim 4, wherein said notch of the slide element is closed at an end opposite said open end thereof by means of a bearing surface matching the shape of the adjacent end of the plate element.

6. Mounting arrangement as claimed in claim 5, wherein said notch has an axial bore that opens through said bearing surface, said bore being in alignment with a threaded hole formed in said plate element, a locking screw passing through said bore and engaging screw-threadedly into said hole for securing the plate element to the slide element.

7. Mounting arrangement as claimed in claim 2, wherein said plate element has two spaced transverse bores, one of said pair of pins on said chain engaging within one said transverse bore whilst the other of said pair of pins engages with axial clearance in said second transverse bore.

8. Mounting arrangement as claimed in claim 7, wherein said second transverse bore is a slot extending lengthwise of the chains.

9. Mounting arrangement as claimed in claim 7, wherein said first and second transverse bores extend entirely through said plate element.

* * * * *